United States Patent [19]

Komossa et al.

[11] 4,364,549

[45] Dec. 21, 1982

[54] APPARATUS FOR FEEDING CARDBOARD BLANKS OR THE LIKE TO A MAGAZINE

[75] Inventors: Werner Komossa, Börnsen; Nils von Wichert, Glinde, both of Fed. Rep. of Germany

[73] Assignee: Hauni- Werke Körber & Co. KG, Hamburg, Fed. Rep. of Germany

[21] Appl. No.: 226,503

[22] Filed: Jan. 19, 1981

[30] Foreign Application Priority Data

Jan. 18, 1980 [DE] Fed. Rep. of Germany ..... 3001733

[51] Int. Cl.[3] ..... B65H 3/24; B65H 3/30; B65H 1/30

[52] U.S. Cl. ..... 271/1; 271/3.1; 271/135; 271/137; 271/139; 271/165; 414/32; 414/115; 493/122

[58] Field of Search ..... 271/1, 166, 165, 3.1, 271/2, 134, 135, 139, 18, 131, 133, 137, 23; 414/115, 126, 131, 125, 32; 221/240, 264; 493/122, 123, 124, 125, 126, 127

[56] References Cited

U.S. PATENT DOCUMENTS

| | | | |
|---|---|---|---|
| 2,877,017 | 3/1959 | Luning et al. | 271/139 |
| 3,416,789 | 12/1968 | Roesner et al. | 271/133 |
| 3,591,018 | 7/1971 | Nalbach | 271/3.1 UX |
| 4,093,207 | 6/1978 | Greenwell et al. | 271/3.1 |

*Primary Examiner*—Bruce H. Stoner, Jr.
*Attorney, Agent, or Firm*—Kontler, Grimes & Battersby

[57] ABSTRACT

Apparatus for supplying preselected numbers of superimposed prefabricated cardboard blanks of the type having alternating larger and smaller marginal flaps from an auxiliary magazine into the main magazine of a packing machine has a frame which carries the auxiliary magazine above the main magazine and is provided with several lugs which support the larger flaps of the lowermost blank in the auxiliary magazine. A photoelectronic detector monitors the height of the supply of blanks in the main magazine and transmits a signal when the height of the supply drops below a preselected value. This initiates pivotal movement of a pusher which is adjacent to one side of the pile of blanks in the auxiliary magazine whereby the pusher shifts a number of lowermost blanks relative to the lugs so that the lugs register with and can be bypassed by the shorter flaps of the thus released blanks which descend into the main magazine by gravity. The movements of the pusher are synchronized with the movements of an intercepting plate which is adjacent to a side of the pile of blanks in the auxiliary magazine opposite the pusher and serves to realign those blanks in the auxiliary magazine which might have become misoriented in response to shifting of the blanks therebelow by the pusher. This ensures that all blanks in the auxiliary magazine are in accurate register with each other at the time the pusher is about to pivot in a direction to release a selected number of blanks for gravitational descent into the main magazine.

12 Claims, 2 Drawing Figures

APPARATUS FOR FEEDING CARDBOARD BLANKS OR THE LIKE TO A MAGAZINE

BACKGROUND OF THE INVENTION

The present invention relates to apparatus for feeding blanks, particularly cardboard blanks, to a magazine or an analogous container. More particularly, the invention relates to improvements in apparatus for intermittently supplying groups or sets of identical or similarly dimensioned blanks to a magazine which cooperates with a suitable singularizing device for delivery of discrete blanks to the processing station of a machine, such as a packing machine for biscuits, cigarette packs or the like. Still more particularly, the invention relates to improvements in apparatus for transferring groups or stacks of overlapping blanks from an upper magazine into a lower magazine whenever the supply of blanks in the lower magazine is depleted to a predetermined extent.

It is well known to store stacks of identical blanks in a main magazine which is adjacent to a processing station in a packing or like machine, for example, in a machine wherein bunches, arrays or other accumulations of commodities to be packed are introduced into prefabricated cartons, boxes or analogous receptacles. As a rule, the blanks are provided with larger and/or smaller flaps which extend from certain panels and must be folded and interlaced or bonded to each other in order to constitute or form part of receptacles for accommodation of groups, arrays or similar accumulations of selected commodities. Typical examples of such commodities are biscuits which are assembled into groups, each of which contains a predetermined number of biscuits, prior to introduction of such groups into partially or fully completed receptacles which are thereupon closed and sealed. In certain instances, the groups of biscuits are provided with wrappers prior to introduction into the receptacles, i.e., prior to introduction into deformed blanks whereby each deformed blank exhibits at least one open side so as to allow for introduction of a group of commodities into its interior. The blanks can be formed with creases or fold lines which extend between the neighboring panels and/or between the panels and the flaps in order to facilitate predictable pivoting, flexing or folding of flaps into planes which normally make angles of 90 degrees with the planes of the neighboring panels and/or neighboring flaps.

As a rule, a magazine for temporary storage of blanks which are used for conversion into receptacles for confinement of arrays of biscuits or the like is provided with an open underside through which a suitable mechanism withdraws one blank at a time and delivers the thus withdrawn blank to a station where the blank is converted into a partially closed receptacle prior to introduction of arrayed or discrete commodities into its interior. It is also known to drape the blank directly around a group of commodities, i.e., to avoid prefabrication of the receptacles by eliminating the step of converting the blanks into empty receptacles which are thereupon filled with commodities.

Heretofore known magazines are acceptable insofar as the singularizing operation is concerned. However, the mechanisms which ensure that the magazines invariably contain a certain number of blanks are cumbersome, complex and expensive. Thus, there exists an urgent need for improved apparatus which can automatically supply or feed preselected quantities of blanks into a main magazine from which the blanks are withdrawn for further processing.

OBJECTS AND SUMMARY OF THE INVENTION

An object of the invention is to provide a novel and improved apparatus for intermittently supplying batches or stacks of overlapping blanks to the magazine of a packing or analogous machine.

Another object of the invention is to provide a novel and improved supplying apparatus which is especially suited for storage and transport of blanks exhibiting larger and smaller prefabricated flaps.

A further object of the invention is to provide an apparatus which can be installed in existing packing and like machines for automatic delivery of batches or stacks of superimposed blanks into the magazines of such machines.

Still another object of the invention is to provide an apparatus which is constructed and assembled in such a way that it can be refilled with blanks without interfering with delivery of blanks from such apparatus to the main magazine of a packing or like machine.

A further object of the invention is to provide an apparatus which can supply relatively large, relatively small, relatively stiff, relatively flexible, rectangular, square or otherwise configurated blanks at desired (regular or irregular) intervals to conventional magazines or to magazines which cooperate with conventional blank singularizing devices.

The invention is embodied in an apparatus for supplying blanks of the type having marginal flaps alternating with recesses into the main magazine of a packing machine or the like. The apparatus comprises an auxiliary magazine located above the main magazine and serving to store a substantially upright pile of overlapping blanks, a plurality of bottom supports located below the lowermost blank of the pile in the auxiliary magazine and normally disposed below the marginal flaps of the lowermost blank to thereby hold the pile against gravitational descent into the main magazine therebelow, and a pivotable pusher or other suitable displacing means which is operable or actuatable to effect a relative movement between the pile in the auxiliary magazine and the supports so as to place the supports into register with the recesses of the lowermost blank of the pile whereby at least some blanks are free to descend from the auxiliary magazine into the main magazine.

The blanks are preferably flat panels consisting of cardboard or the like, and the pile includes a stack of parallel blanks. The displacing means includes means for effecting the aforementioned relative movement in a direction which is substantially parallel to the planes of blanks forming the pile.

In accordance with a presently preferred embodiment of the invention, the apparatus further comprises stationary frame means for the supports and the displacing means includes the aforementioned pusher which is actuatable to move at least some blanks at the bottom of the pile in the auxiliary magazine relative to the supports between a first position in which the flaps of the lowermost blank of the pile rest on the supports and a second position in which the supports register with the recesses of at least some blanks in the bottom part of the pile in the auxiliary magazine. The pusher preferably comprises or constitutes a member which is pivotable about a substantially horizontal axis between a first position in which the blanks in the lower part of the auxiliary magazine are free to assume their first positions and a second position in which the pivotable member maintains the blanks at the lower end of the pile in the aforementioned second positions so that the blanks can descend into the main magazine by gravity.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
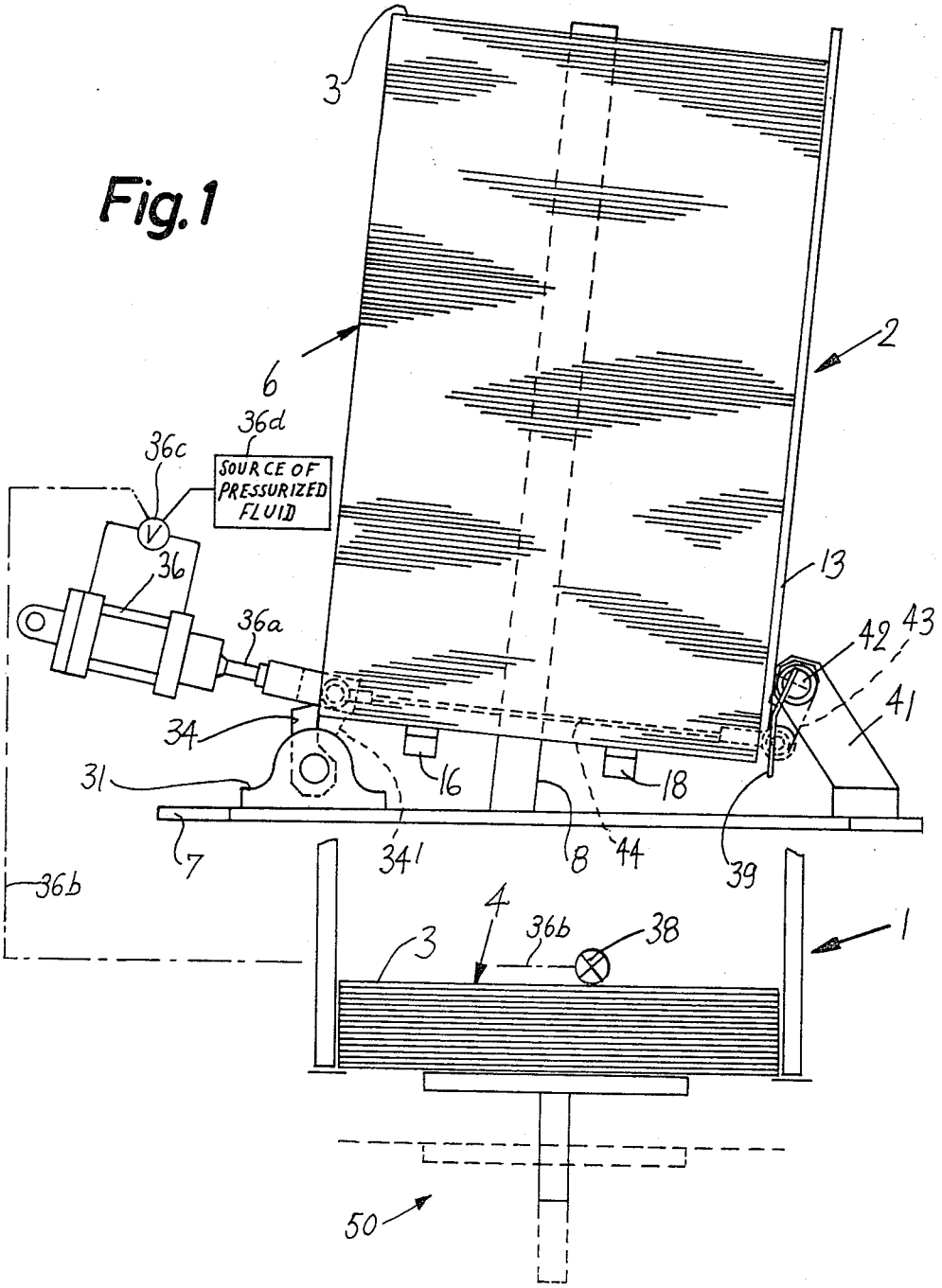
FIG. 1 is a somewhat schematic side elevational view of a main magazine and of a superimposed blank supplying apparatus which embodies the present invention.
Figure 2:
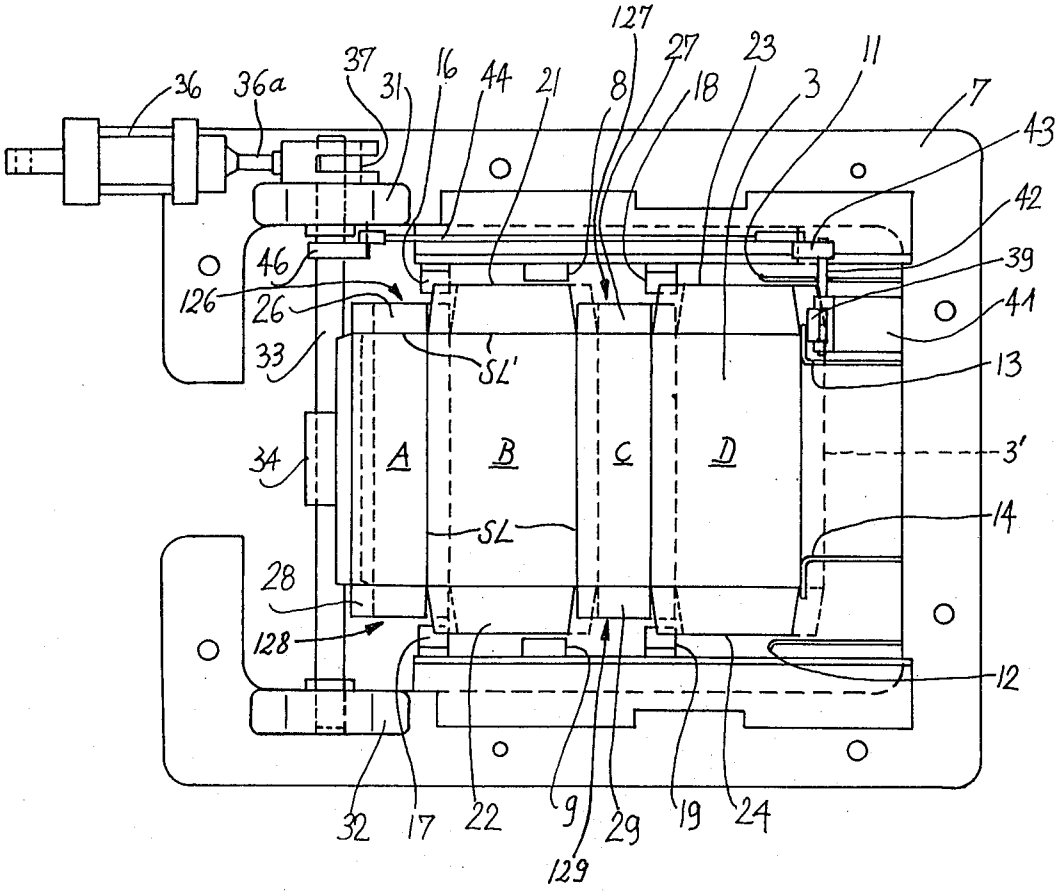
FIG. 2 is a plan view of the apparatus which is shown in FIG. 1.

The structure which is shown in FIGS. 1 and 2 is installed in a packing machines for biscuits or the like. The biscuits are assembled into groups or other arrays and are introduced into receptacles which are obtained in response to suitable manipulation of prefabricated blanks 3 which are withdrawn seriatim from the lower end of a first or main magazine 1 shown in the lower part of FIG. 1. The underside of the magazine 1 is at least partially open so as to allow for withdrawal of successive lowermost blanks 3 by a singularizing mechanism 50 certain component parts of which are shown below the magazine 1 in the lower part of FIG. 1. The details of the singularizing mechanism 50 form no part of the present invention. It suffices to say that such mechanism withdraws successive lowermost blanks 3 from the main magazine 1 and delivers the withdrawn blanks to a station in the packing machine where the blanks are converted into receptacles, either prior to reception of groups of biscuits or other commodities or directly around such groups. Reference may be had to commonly owned U.S. Pat. No. 4,161,094 granted July 17, 1979 to Otto Blidung et al. It is further clear that the magazine 1 of FIG. 1 can deliver blanks to other types of machines, for example, to machines wherein groups consisting of predetermined numbers of cigarettes are introduced into soft or hard cigarette packs.

The improved apparatus comprises a second or auxiliary magazine 2 which is installed on a supporting frame 7 at a level above the main magazine 1. The main magazine 1 contains a relatively low stack 4 of superimposed accurately overlapping blanks 3, and the auxiliary magazine 2 contains a much higher pile or stack 6 of superimposed blanks 3. The stack 4 in the lower or main magazine 1 is substantially upright, and the stack or pile 6 in the auxiliary magazine 2 is slightly inclined so that the blanks 3 therein exhibit at least some tendency to slide in a direction to the right, as viewed in FIG. 1. The auxiliary magazine 2 comprises several nearly upright side walls or guides 8, 9, 11, 12, 13 and 14 which define a skeleton duct for storage of the pile or stack 6 of spare blanks 3 therein. Each such blank is assumed to constitute a flat body of lightweight cardboard or a similar material. The supporting frame 7 of the improved apparatus carries four suitably distributed bottom supports 16, 17, 18, 19 which are substantially horizontal lugs extending into the space between the side walls 8, 9, 10 and 11 to 14 and serve to temporarily support the lowermost blank 3 of the pile 6 in the auxiliary magazine 2. The lower end portions of the right-hand side walls 13 and 14 (as viewed in FIGS. 1 and 2) extend to a certain level above the common plane of the upper sides or supporting surfaces of the bottom supports 16, 17, 18 and 19. The difference between the level of such supporting surfaces and the level of the lower end portions of the side walls 13 and 14 determines the height of that partial stack or group of superimposed blanks 3 which is removed from the auxiliary magazine 2 and transferred into the main magazine 1 whenever the height of the stack 4 in the main magazine 1 is reduced to a predetermined value which warrants the admission of a fresh supply of prefabricated blanks 3. Each group of blanks 3 which are released from the auxiliary magazine 2 for transfer into the main magazine 1 descends by gravity and lands on top of the uppermost blank 3 of the stack 4 in the main magazine 1.

As can be seen in FIG. 2, each blank 3 comprises four panels A, B, C, D and eight flaps extending from the shorter sides of the panels A to D. Thus, the panel A is flanked by two relatively short flaps 26 and 28; the next panel B is flanked by two relatively long flaps 21 and 22; the third panel C is flanked by two relatively short flaps 27 and 29; and the fourth panel D is flanked by two relatively large or long flaps 23 and 24. The flaps 26 and 28 are preferably identical with the flaps 27 and 29, and the flaps 21 and 22 are preferably identical with flaps 23 and 24. The manner in which a blank 3 can be converted into a receptacle for storage of a predetermined number of identical or different commodities is believed to be self-evident. To facilitate the folding or bending of the panels A to D relative to each other, the neighboring panels are partially separated from each other by weakened portions in the form of score lines SL. Additional score lines SL' are provided between the panels A to D on the one hand and the respective shorter and longer flaps on the other hand. Each blank 3 can be converted into a substantially brick-shaped receptacle for a certain number of commodities, for example, ten biscuits. It will be noted that the shorter flaps 26 and 27 at one side of each blank 3 alternate with the longer flaps 21 and 23, and the same holds true for the other side of each blank 3, i.e., the shorter flaps 28 and 29 alternate with the longer flaps 22 and 24. Such distribution of flaps is utilized, in accordance with the present invention, to facilitate rapid disengagement of the bottom supports 16, 17, 18 and 19 from the lowermost blank 3 in the auxiliary magazine 2 preparatory to transfer of a group of superimposed overlapping blanks 3 into the main magazine 1. As shown in FIG. 2, the horizontal upper sides of surfaces of the bottom supports 16, 17, 18 and 19 support the four longer flaps 21, 22, 23 and 24 of the lowermost blank in the auxiliary magazine 2. By displacing or shifting a certain group of blanks in the bottom zone of the auxiliary magazine 2 relative to the bottom supports 16 to 19, such group of freshly released blanks 3 can readily descend into the lower magazine 1 to come to rest on top of the uppermost blank of the stack 4. FIG. 2 shows the position of the lowermost blank 3 in the auxiliary magazine 2 by solid lines and the position of such blank subsequent to disengagement from the bottom supports 16 through 19 by broken lines.

The supporting frame 7 further carries two spaced apart bearing blocks 31 and 32 for the end portions of a turnable horizontal shaft 33 the central portion of which carries a displacing element or pusher 34 in the form of a plate which is rigidly attached to and extends upwardly from the median portion of the shaft 33. The pusher 34 is adjacent to a very narrow sealing flap of the adjacent blank 3. This sealing flap 51 extends to the left-hand side of the leftmost panel A shown in FIG. 2. The operating or actuating means for tuning the shaft 33 about its axis so as to cause the pusher 34 to shift a group of blanks 33 at the lower end of the pile 6 in the auxiliary magazine 2 relative to the bottom supports 16 through 19 comprises a double-acting fluid-operated motor 36, preferably a pneumatic cylinder and piston unit having a piston rod 36*a* which is articulately connected to an eccentric portion 37 of the shaft 33.

The motor 36 can pivot the pusher 34 between the solid-line position and the broken-line position 34' of FIG. 1. The length of the pusher 34, as considered in the radial direction of the shaft 33, determines the height of that group of superimposed blanks 3 which is permitted to descend into the main magazine 1 in response to pivoting of the pusher to the broken-line position 34' of FIG. 1. Such movement of the pusher 34 entails a lateral shifting of the lower portion of the pile 6 so that the right-hand marginal portions of the panels D of the lower blanks 3 in the auxiliary magazine 2 assume the positions which are indicated by broken lines (see the position 3' of the lowermost blank 3 shown in FIG. 2). The extent of pivotable movement of the pusher 34 to the position 34' must suffice to disengage the longer flaps 21, 22, 23 and 24 from the respective bottom supports 16, 17, 18 and 19 so that the aforementioned group of blanks 3 can descend by gravity. As mentioned above, the lower end portions of the side walls 13 and 14 terminate at a certain level above the upper surfaces of the bottom supports 16 through 19; this enables the rightmost panels D of the selected group of blanks 3 to move below the undersides of the side walls 13 and 14 simultaneously with disengagement of the major or longer flaps 21 through 24 from the respective bottom supports 16 through 19. The auxiliary magazine 2 is preferably open at one side (i.e., at the left-hand side, as viewed in FIG. 1 or 2), in order to allow for introduction of fresh blanks 3 on top of the dwindling pile 6 in the auxiliary magazine. The slight inclination of side walls 13 and 14 allows for convenient stacking of freshly inserted blanks 3 on top of the blanks which form the pile 6.

It will be noted that the lengths of the bottom supports 16 through 19 and the lengths of the shorter flaps 26, 27, 28 and 29 of the blanks 3 are selected in such a way that the shorter flaps can bypass the bottom supports when the blanks of the group at the lower end of the pile 6 assume the positions 3' shown in FIG. 2 by broken lines. In other words, the flaps 26 through 29 are sufficiently short to prevent their engagement with the bottom supports 16 through 19 while a groups of blanks 3 descends by gravity from the lower portion of the auxiliary magazine 2 into the upper portion of the main magazine 1, namely, on top of the stack 4. It goes without saying that proper operation of the apparatus which includes the auxiliary magazine 2 presupposes proper stacking of blanks 3 which form the supply or pile 6. The positions of the side walls 8, 9, 11, 12, 13 and 14 are selected in such a way that the blanks 3 which are introduced into the auxiliary magazine 2 are compelled to automatically assume optimum positions for transfer into the magazine 1 therebelow.

The means for initiating the operation of the actuating means 36 so as to effect the transfer of a group of blanks 3 from the auxiliary magazine 2 into the main magazine 1 comprises a level detector 38 which may include one or more photoelectric cells and monitors the height of the stack 4. When such height decreases to a predetermined minimum value, the transducer of the photocell 38 transmits a signal via conductor means 36*b* to open a valve 36*c* connecting the chambers of the motor 36 with a source 36*c* of pressurized fluid (preferably compressed air). The exact mode of operation of the valve 36*c* forms no part of the present invention. It suffices to say that the valve 36*c* causes the motor 36 to pivot the pusher 34 in a clockwise direction, as viewed in FIG. 1, whenever the valve receives an electric signal from the transducer of the detector 38. The motor 36 is preferably designed in such a way that it automatically retracts the pusher 34 to the solid-line position of FIG. 1 after a preselected interval of dwell in the broken-line position 34' so as to enable the lower portion of the remaining pile 6 in the auxiliary magazine 2 to descend into the upper surfaces of the bottom supports 16 through 19.

When the height of the pile 6 in the auxiliary magazine 2 is reduced considerably and the attendant or an automatic transfer mechanism has failed to replenish the supply of blanks 3 in the auxiliary magazine, the blanks 3 which are shifted by the pusher 34 (while the pusher moves to the position 34' of FIG. 1) are likely to effect at least some shifting, misalignment or change of orientation of the blanks 3 immediately above the blanks which are about to leave the magazine 2 in order to enter the main magazine 1. Even a very slight misalignment of those blanks which are located at a level above the pusher 34 can lead to improper operation of the improved apparatus, i.e., to unsatisfactory transfer of successive groups of blanks into the main magazine 1.

In order to prevent any, even slight, misalignment of blanks 3 which are not engaged by the pusher 34 while the pusher advances to the position 34' of FIG. 1, the apparatus preferably further comprises an intercepting device here shown as a sheet-metal barrier 39 which is adjacent to the lower right-hand side of the pile 6 in the auxiliary magazine 2, as viewed in FIG. 1. In other words, the barrier 39 is located opposite the pusher 34. The barrier 39 is secured to a horizontal shaft 42 which is parallel to the shaft 33 and is rotatably mounted in a bearing block 41 carried by the adjacent portion of the supporting frame 7. The barrier 39 extends downwardly from the shaft 42, as viewed in FIG. 1. The shaft 42 is further connected with a lever 43 which is articulately connected to a lever 46 secured to the shaft 33. The articulate connection between the levers 43 and 46 comprises an elongated connecting rod or link 44 which causes the barrier 39 to pivot in response to pivoting of the pusher 34, i.e., in response to turning of the shaft 33 by the motor 36. The pivotal movements of the barrier 39 are synchronized with the pivotal movements of the pusher 34 in such a way that, whenever the barrier 39 is pivoted in a clockwise direction, as viewed in FIG. 1, its lower portion automatically returns any misaligned blanks in the bottom portion of the pile 6 to their optimum positions for subsequent transfer into the main magazine 1 in response to renewed pivotal movement of the pusher 34 to the broken-line position 34' of FIG. 1. This ensures that each and every descending blank 3 enters the main magazine 1 as well as that the blanks at the bottom of the pile 6 in the auxiliary magazine 2 invariably rest on the bottom supports 16 through 19 as long as the pusher 34 remains in the solid-line position of FIG. 1.

An important advantage of the improved apparatus is that it takes advantage of the customary configuration or design of the blanks 3 to ensure predictable transfer of preselected numbers of blanks from the auxiliary magazine 2 into the main magazine 1. This is due to the fact that the positions and dimensions of the supporting elements or bottom supports 16 through 19 are selected in such a way that these bottom supports can engage the longer flaps 21 through 24 but can be bypassed by the shorter flaps 26 through 29. Furthermore, such utilization of the dimensions of the shorter flaps 26 through 29 and bottom supports 16 through 19 to allow for release of a predetermined number of blanks from the auxiliary magazine and entry into the main magazine renders it possible to disengage the longer flaps 21 through 24 from the bottom supports 16 through 19 in response to an extremely small angular displacement of the shaft 33. It can be said that the shorter flaps 26 through 29 define gaps or recesses (126, 127, 128, 129) between the longer flaps 21 through 24, and that the depth of the recesses suffices to ensure that the lowermost blanks 3 of the pile 6 can leave the magazine when such recesses receive the supports 16 through 19.

The photocell 38 cooperates with the valve **36*c* and motor 36 to pivot the pusher 34 in time for delivery of a fresh group of blanks 3 from the auxiliary magazine 2 into the main magazine before the supply of blanks 3** in the main magazine is exhausted or drops below a preselected lowermost permissible level.

It is also possible to design the improved apparatus in such a way that the pusher 34 or other suitable displacing means shifts the lugs or bottom supports 16 through 19 relative to the pile 6 in the auxiliary magazine 2. The construction which is shown in the drawing is preferred at this time because it is much easier and simpler to release a given number of blanks 3 at a time, i.e., to allow a group which contains a predetermined number of blanks 3 to leave the auxiliary magazine 2 and enter the main magazine 1.

The intercepting device or barrier 39 invariably returns any misaligned blanks 3 into register with the remaining blanks of the pile 6 not later than when the pusher 34 again performs an angular movement to the position 34'. As shown, the pusher 34 and the barrier 39 are disposed at two opposite sides of the pile 6 in the auxiliary magazine 2. The barrier 39 not only returns misaligned blanks 3 into proper positions in the interior of the auxiliary magazine 2 but also serves as a means for braking the movement of blanks above the pusher 34 from their optimum positions.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for supplying blanks of the type having marginal flaps alternating with recesses into the main magazine of a packing machine or the like, comprising an auxiliary magazine located above the main magazine and arranged to store a substantially upright pile of overlapping blanks each having oppositely opposed first and second sides; a plurality of supports located below the lowermost blank of the pile in said auxiliary magazine and normally disposed below the marginal flaps of such lowermost blank to thereby hold the pile against gravitational descent into the main magazine therebelow; displacing means operable to effect a relative movement between the pile in said auxiliary magazine and said supports so as to place the supports into register with the recesses of the pile whereby at least some blanks of the pile are free to descend into the main magazine by gravity, said displacing means including pusher means adjacent to one of the sides of said blanks, said pusher means arranged to move at least some blanks at the lower end of the pile in said auxiliary magazine between a first position in which the lowermost blank of the pile rests on said supports and a second position in which said supports register with the recesses of said some blanks; intercepting means adjacent to the other side of the pile in said auxiliary magazine and arranged to prevent movement of those blanks of the pile not displaced by said pusher means; and means for coupling said intercepting means for movement with said pusher means so as to enable said intercepting means to move away from said other side of the pile when said pusher means shifts a number of blanks to move the recesses of such blanks into register with said supports and to move toward said other side of the pile when said pusher means thereupon reassumes a predetermined starting position in which it allows the lowermost blank of the remainder of the pile in said auxiliary magazine to rest its flaps on said supports.

2. The apparatus of claim 1, wherein said blanks are flat and said pile includes a stack of parallel blanks, said displacing means including means for effecting said relative movement in a direction which is substantially parallel to the planes of blanks forming said pile.

3. The apparatus of claim 1, further comprising stationary frame means for said supports.

4. The apparatus of claim 3, wherein said pusher means includes a member which is pivotable between a first position in which the blanks at the lower end of the pile in the auxiliary magazine are free to assume said first positions and a second position in which said member maintains the blanks at the lower end of said pile in said second positions.

5. The apparatus of claim 4, wherein said member of said pusher means is pivotable about a substantially horizontal axis and further comprising actuating means for pivoting said member between said first and second positions.

6. The apparatus of claim 5, wherein said actuating means comprises a shaft rigid with said member of said pusher means and motor means for turning said shaft back and forth.

7. The apparatus of claim 6, wherein said motor means includes a fluid-operated motor.

8. The apparatus of claim 7, wherein said fluid-operated motor includes a double-acting pneumatic cylinder and piston nut.

9. The apparatus of claim 1, wherein said intercepting means is pivotable about a first fixed axis and said pusher means is pivotable about a second fixed axis parallel to said first axis, said coupling means comprising link means articulately connecting said intercepting means with said pusher means.

10. The apparatus of claim 9, further comprising first and second shafts respectively defining said first and second axes, said coupling means further comprising first and second levers rigid with the respective shafts, said link means being articulately connected to said levers.

11. The apparatus of claim 1, further comprising means for actuating said displacing means and means for operating said actuating means in dependency on the height of the supply of blanks in the main magazine, said operating means including signal generating means for monitoring the height of the supply of blanks in the main magazine and means for setting said actuating means in motion in response to signals denoting that the height of the supply of blanks in the main magazine has been depleted to a predetermined lowermost level.

12. The apparatus of claim 11, wherein said monitoring means includes photoelectronic detector means and said actuating means includes motor means operative to pivot said displacing means into and from engagement with a predetermined number of blanks at the bottom of the pile of blanks in said auxiliary magazine.

* * * * *